US006470932B1

(12) United States Patent
Grivna et al.

(10) Patent No.: US 6,470,932 B1
(45) Date of Patent: Oct. 29, 2002

(54) AUTOMATIC CENTERING SYSTEM FOR FINISHING MACHINE

(75) Inventors: Howard Grivna, Maple Grove; Peter Loring, Robbinsdale, both of MN (US)

(73) Assignee: Timesavers, Inc., Minneapolis, MN (US)

( * ) Notice: Subject to any disclaimer, the term of this patent is extended or adjusted under 35 U.S.C. 154(b) by 103 days.

(21) Appl. No.: 09/607,198

(22) Filed: Jun. 28, 2000

Related U.S. Application Data

(63) Continuation-in-part of application No. 09/358,197, filed on Jul. 21, 1999.

(51) Int. Cl.[7] ..... B27C 1/00; B27C 11/00

(52) U.S. Cl. ..... 144/373; 144/117.1; 144/115; 144/242.1; 144/246.1; 144/248.4; 144/250.26; 144/375; 144/357; 144/382; 198/782; 198/836.2; 451/301; 451/336

(58) Field of Search ..... 144/114.1, 116, 144/117.1, 115, 242.1, 246.1, 248.4, 250.26, 2.1, 373, 375, 356, 357, 382; 198/782, 836.2; 451/190, 300, 301, 302, 336

(56) References Cited

U.S. PATENT DOCUMENTS 3,941,019 A 3/1976 Baldwin et al.
4,322,919 A 4/1982 Gerber
4,457,350 A * 7/1984 Finnila ..... 144/117.1
4,596,172 A 6/1986 Visser
4,640,056 A 2/1987 Stump
4,724,877 A 2/1988 Culley, Jr.

* cited by examiner

*Primary Examiner*—W. Donald Bray
(74) *Attorney, Agent, or Firm*—Patula & Associates, P.C.

(57) ABSTRACT

A method and apparatus for improved centering of a workpiece in a surfacing machine includes centering assembly having a plurality of individually movable biasing element sets, comprising an upper element and a lower element. Each element set is operatively connected to a closed circuit, double rod end hydraulic cylinder assembly which selectively and independently positions the element set responsive to the surface to the workpiece. The hydraulic cylinder assembly includes a valve. A pressure device is also operatively connected to each element set to provide a centering force. In use, as the upper or lower element of an element set is forced away from the centerline of the workpiece, the opposing element would automatically move the same amount when the valve is closed. When the valve is open, the upper and lower elements are free to move independently, allowing the centerline to be easily positioned as desired. The shoe assembly thus centers each and every workpiece independent of the amount of stock removal required.

19 Claims, 3 Drawing Sheets

AUTOMATIC CENTERING SYSTEM FOR FINISHING MACHINE

RELATED APPLICATION

This application is a continuation in part of co-pending application Ser. No. 09/358,197, filed Jul. 21, 1999, the entire disclosure of which is hereby incorporated by reference.

The present invention relates to a method and apparatus for positioning workpieces in surfacing machinery, and in particular, an automatic centering system for automatically centering workpieces in a finishing machine, specifically an automatically centering system for a sectional shoe assembly or an infeed assembly, having opposing shoes or feed rollers connected via hydraulic balancing circuits. The hydraulic balancing circuits are coupled by a valve which selectively separates or connects the circuits, allowing the opposing shoes or rollers to selectively move together or independently, respectively. When the circuits are connected by opening the valve, the centerline location can be adjusted.

BACKGROUND OF THE INVENTION

Surfacing machinery is used to perform surface operations on workpieces, for example, to sand or plane lumber, planks, panels, etc. Such surfacing machinery typically includes upper and lower heads for cutting or sanding the workpieces, and a feed assembly for advancing the workpiece through the heads. The feed assembly preferably provides a self-centering effect so that whatever amount of material is being removed, one-half will be removed from each side, thereby maximizing yield.

Self-centering feed assemblies for abrasive grinding machines are disclosed in U.S. Pat. No. 4,322,919 issued to Gerber on Apr. 6, 1982 and in U.S. Pat. No. 4,640,056 issued to Stump on Feb. 3, 1987, both of which are herein incorporated by reference. These prior art feed assemblies allowed each workpiece to float or center at the sanding head position and to thereby achieve equal stock removal on each side of each board. Because the abrasive belt heads themselves had a self-centering effect, these feed assemblies were required to provide the necessary horizontal forces required to feed each board, but follow the surface of each board so as to not interfere with the centering effect at the abrasive belt heads.

However, when used in connection with cutting heads, as opposed to sanding or grinding heads, these prior art feed assemblies were not adequate to achieve the desired individual centering result, since the cutting heads do not provide a self-centering effect. This is due to the fact that when using cutting heads instead of abrasive heads, the vertical forces on the workpiece are exactly the opposite, as a cutting head tries to pull the board into the cutter, whereas an abrasive head tries to push the board away from the abrasive belt. As a result, the cutting heads would remove an unequal amount from each side and tend to gouge or otherwise cut the workpiece unevenly, especially if the workpiece is uneven, warped or contains other variations. In an attempt to compensate for such problems, the cutting heads normally are displaced relative to each other, as opposed to the desired position of directly opposing each other, resulting in uneven stock removal from each side.

Accordingly, there is a need in a cutting head planer machine for a method and apparatus to adequately center and feed workpieces to the cutting head assembly so that an equal amount of material will be removed from both sides of each and every board independent of individual board thickness variations. There is a further need in all types of surfacing or finishing machines to provide an improved centering assembly. The present invention fulfills such needs.

BRIEF SUMMARY OF THE INVENTION

The present invention comprises an automatic centering system for a sectional shoe assembly or an infeed assembly for use in surfacing machinery. The shoe assembly and the infeed assembly include a plurality of individually movable biasing element sets, i.e., shoe sets and feed roller sets respectively, each set comprising an upper element and a lower element. Each element set is operatively connected to a closed circuit, double rod end hydraulic cylinder assembly which selectively and independently positions the element set responsive to the surface to the workpiece. A means for exerting a force is provided to selectively position each element set to provide a centering force. The means for exerting a force can take the form of an air circuit which selectively exerts pressure on the double rod end hydraulic cylinders of the centering assembly.

The hydraulic cylinder assembly includes two circuits coupled by a valve. When the valve is closed, the circuits are separated and the element sets move together. When the valve is open, the circuits are joined and the element sets move independently of each other.

In use, when the valve is closed, as the upper or lower element of an element set is forced away from the centerline of the workpiece, the opposing element will automatically move the same amount. The shoe and/or infeed assembly thus centers each and every workpiece independent of the amount of stock removal required. When the valve is open, the upper or lower element of an element set is free to move independently of the other element. As such, the centerline position can be easily adjusted.

Accordingly, it is the principle object of the present invention to provide a method and apparatus for positioning workpieces in surfacing machinery.

It is a further object of the invention to provide a centering assembly for centering workpieces in a surfacing machine.

It is also an object of the invention to provide an automatic centering assembly that adjusts for individual workpiece thicknesses and widths allowing multiple workpieces to be centered and planed at the same time by a surfacing machine.

It is an additional object of the present invention to provide a hydraulic cylinder assembly for a shoe or infeed assembly.

It is another object of the present invention to provide an improved centering assembly having a closed circuit, double rod end hydraulic cylinder assembly.

It is yet another object of the present invention to provide in a centering assembly, a hydraulic cylinder assembly including two circuits coupled by a valve to provide selective movement of element sets of the centering assembly.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
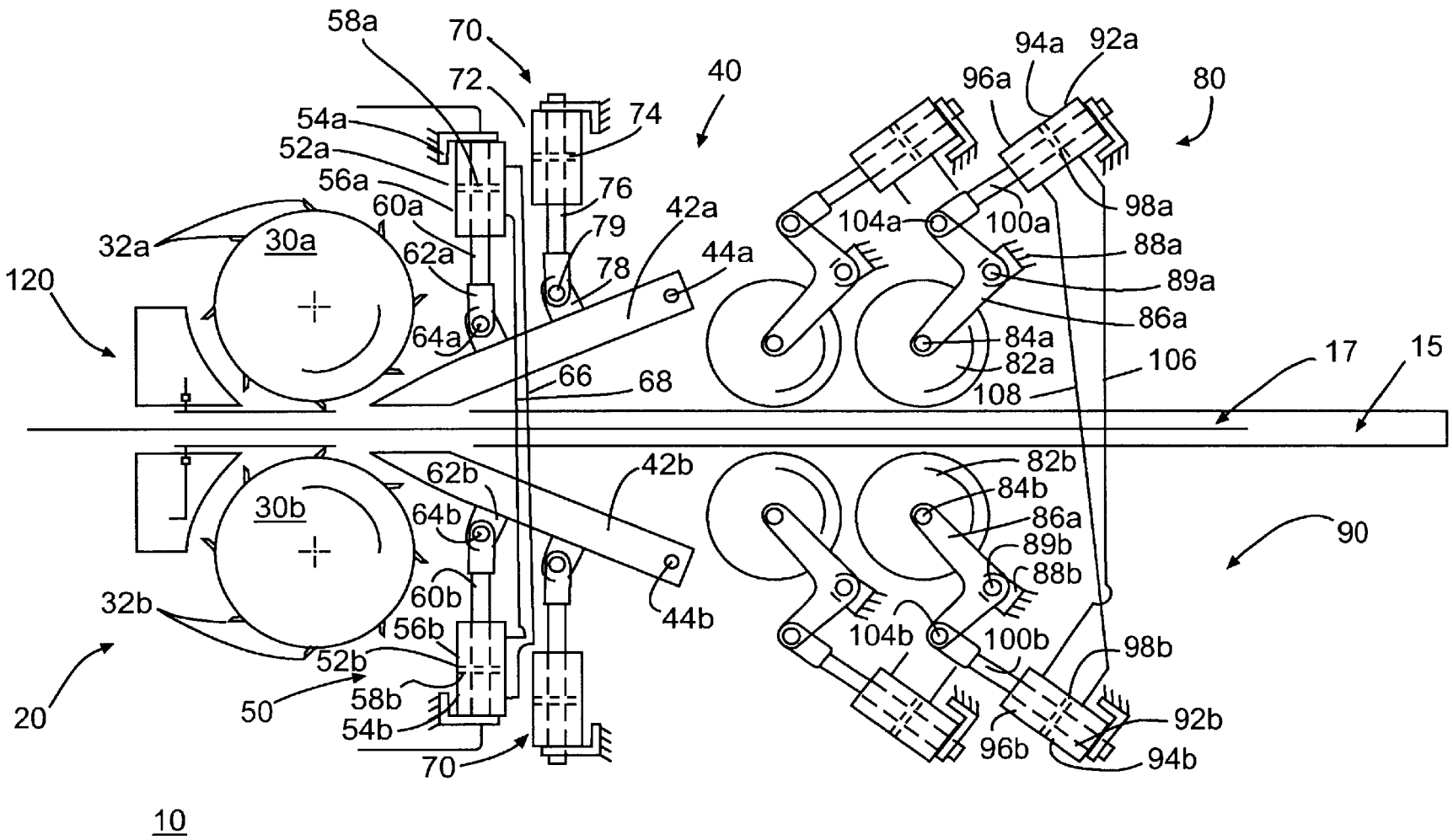
FIG. 1 is a side view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

FIG. 1 illustrates a side view of the present invention 10 in use in a cutting head planer machine having a cutting head assembly 20 defined by directly opposed upper cutting head 30*a* and lower cutting head 30*b*. The cutting heads each include cutting teeth 32*a* and 32*b* respectively, are suitably mounted and driven as is commonly known in the art. The cutting heads are mounted at any desired distance from each other, to define the thickness or height of the finished workpiece. For example, if the cutting heads are set one inch apart, then a workpiece with a thickness greater than one inch will have a thickness of one inch after passing through the workpiece.

A centering shoe assembly 40 is shown positioned in close proximity to the cutting heads. Assembly 40 comprises a series of shoe sets, positioned across the width of the machine, each set made up of upper shoe 42*a* and lower shoe 42*b*. The shoes 42*a* and 42*b* are mounted for pivotable movement about pivots 44*a* and 44*b* respectively. Movement of each set of shoes is effected as described below by closed circuit, double rod end hydraulic cylinder assemblies 50 operatively connected to each shoe set.

The shoes assemblies are mounted such that the minimum distance between the upper and lower shoes is less than the distance between the cutting heads. For example, if the distance between the cutting heads is one inch, then the minimum distance between the upper and lower shoes would be less than one inch, such as ⅞ inches. In such an example, a workpiece having an initial thickness of less than one inch will pass through the machine unaffected, i.e, without contacting the cutting heads. In the prior art, a workpiece originally thinner than desired would still contact the surfacing heads and be made even thinner.

Assembly 50 comprises an upper double rod end hydraulic cylinder 52*a* and a lower double rod end hydraulic cylinder 52*b*. Each cylinder 52*a* and 52*b* contains a fluid (such as oil or any suitable liquid or gas) filled first chamber 54*a* and 54*b* and second chamber 56*a* and 56*b* respectively, separated by a piston 58*a* and 58*b* respectively. Pistons 58*a* and 58*b* move piston rods 60*a* and 60*b* respectively, which are pivotably attached to a shoe mount 62*a* and 62*b* respectively, by pivot 64*a* and 64*b* respectively, to control movement of shoes 42*a* and 42*b*.

Cylinders 52*a* and 52*b* are operatively connected by a first conduit 66 and a second conduit 68. First conduit 66 provides fluid communication between first chamber 54*a* and second chamber 56*b*, while second conduit 68 provides fluid communication between second chamber 56*a* and first chamber 54*b*. In this manner, as one of the pistons 58*a* and 58*b* move, the other piston moves the same amount in the same direction relative to the center line (i.e, both move either away from the centerline or towards the centerline), since the volume of the fluid in the first chambers 54*a* and 54*b* and the volume in the second chambers 56*a* and 56*b* remain equal. Thus, if shoe 42*a* is forced away from centerline 17 by workpiece 15, piston 58*a* moves, forcing fluid out of first chamber 54*a*, through conduit 66, and into second chamber 56*b*. This in turn moves piston 52*b*, forcing fluid out of first chamber 54*b*, through conduit 68 and into second chamber 56*a*, thus moving shoe 42*b* away from the center line the same distance as shoe 42*a*.

To provide a centering force, a means 70 for exerting pressure on the shoes is operatively connected to at least one of the shoes 42*a* and 42*b*. As illustrated in FIG. 1, means 70 takes the form of an air cylinder 72 having piston 74 which moves piston rod 76 pivotably attached to the shoe at shoe mount 78 by pivot 79. Air cylinder 72 selectively provides adjustable pressure to the shoes to help produce the desired centering effect.

Also illustrated in FIG. 1 is a centering feed assembly 80 having a plurality of staggered drive wheel sets, of the general type as described in U.S. Pat. No. 4,322,919. It should be understood that a feed mechanism of the general type as described in U.S. Pat. No. 4,640,056 could also be used.

The feed assembly 80 however differs from these prior art feed assemblies in that they are operatively controlled by another closed circuit double rod end hydraulic cylinder assembly 90. Accordingly, opposing drive wheels 82*a* and 82*b* are mounted on drive shafts 84*a* and 84*b* respectively, and are driven by any suitable means as is known in the art. Drive wheels 82*a* and 82*b* are mounted at the and of an L-shaped link 86*a* and 86*b* respectively, which pivot at link mounts 88*a* and 88*b* respectively about link pivots 89*a* and 89*b* respectively.

Assembly 90 comprises an upper double rod end hydraulic cylinder 92*a* and a lower double rod end hydraulic cylinder 92*b*. Each cylinder 92*a* and 92*b* contains a fluid filled first chamber 94*a* and 94*b* and second chamber 96*a* and 96*b* respectively, separated by a piston 98*a* and 98*b* respectively. Pistons 98*a* and 98*b* move piston rods 100*a* and 100*b* respectively, which are pivotably attached to the other end of link 86*a* and 86*b* respectively, by pivot 104*a* and 104*b* respectively, to control movement of drive wheels 82*a* and 82*b*.

Cylinders 92*a* and 92*b* are operatively connected by a first conduit 106 and a second conduit 108. First conduit 106 provides fluid communication between first chamber 94*a* and second chamber 96*b*, while second conduit 108 provides fluid communication between second chamber 96*a* and first chamber 94*b*. Thus when one drive wheel moves away from the centerline 17, the opposite wheel move away from the centerline an equal distance. This provides an improved centering effect of the workpiece 15 as it is move d through the cutting heads 30*a* and 30*b*, and into exit shoe assembly 120 which supports, stabilizes, guides and provides a flattening effect to the finished workpiece as it exits the cutting head assembly 20.

Figure 2:
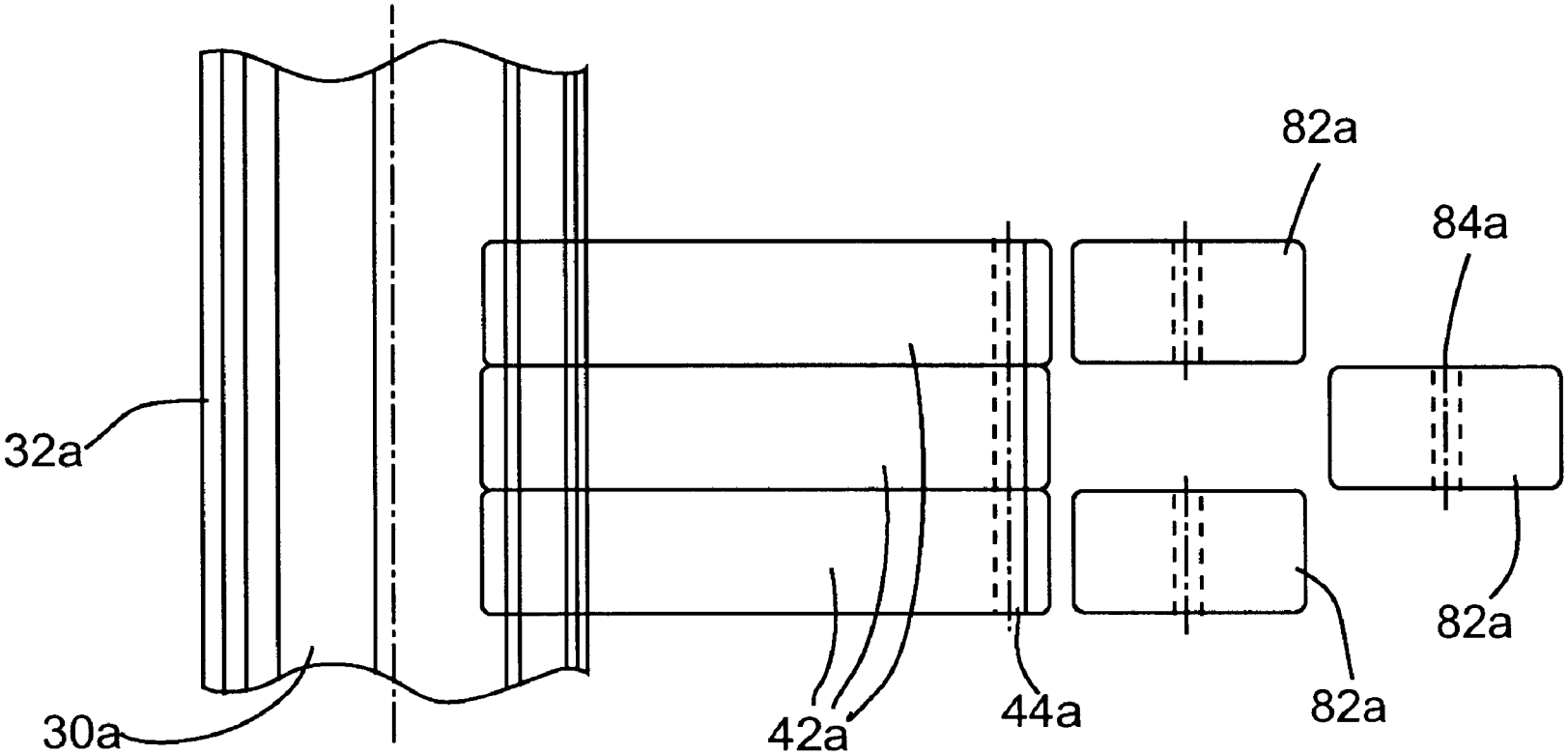
FIG. 2 is a top view of the present invention in the absence of the hydraulic cylinder assemblies.

FIG. 2 is a top view of the present invention, in the absence of assemblies 50 and 90, and means 70, illustrating the relative location of the staggered drive wheels 82*a*, the sectional shoes 42*a*, and the cutting head 30*a*. As can be seen, the sectional shoes are located between the cutting head and the drive wheels, in close proximity to the cutting head. It should be understood that the drive wheels need not be staggered, but could be aligned.

Figure 3:
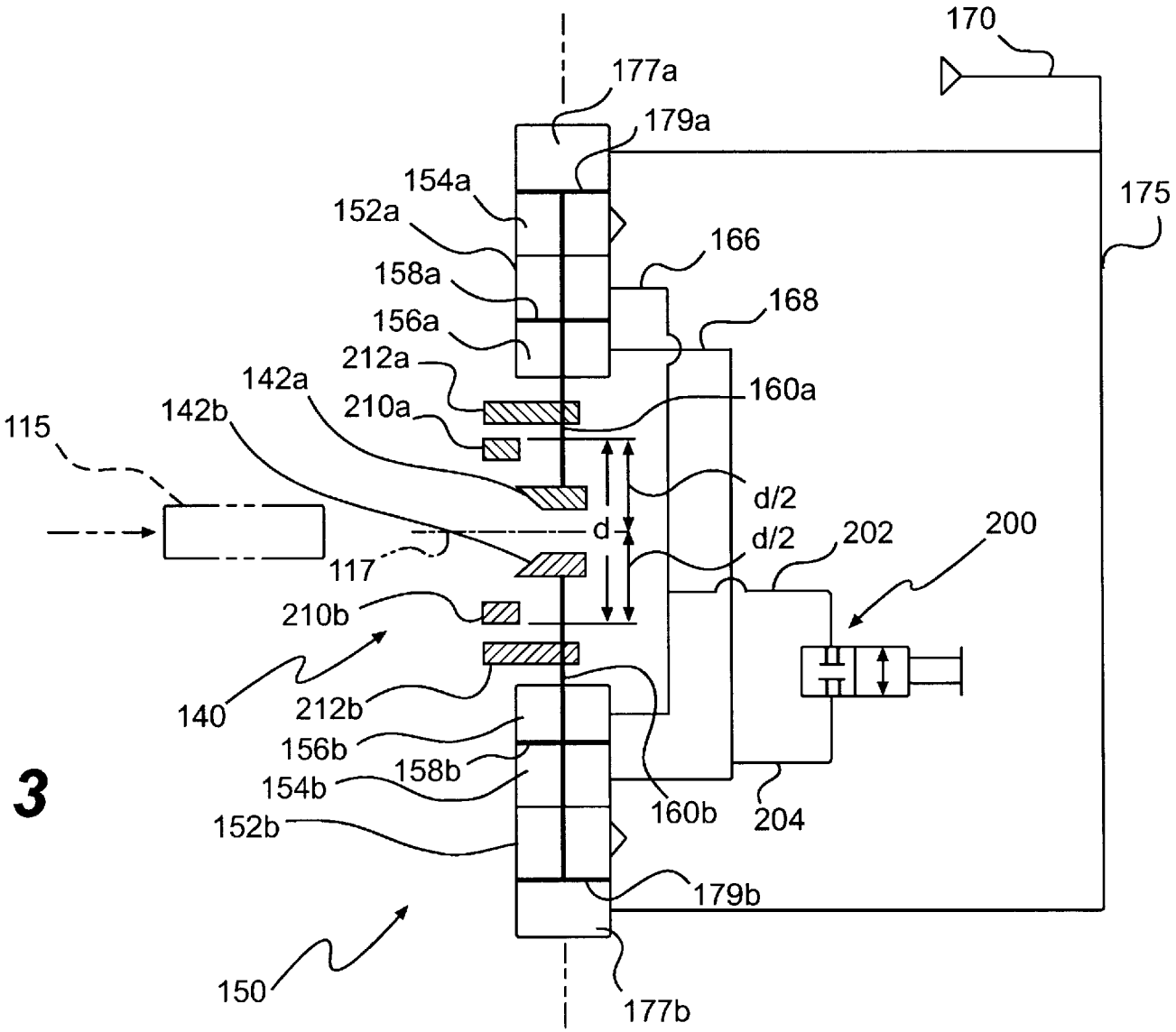
FIG. 3 is a schematic diagram of the hydraulic balancing circuit assembly of the present invention.

FIG. 3 illustrates a schematic diagram of a hydraulic circuit assembly 150 similar to assembly 50 and 90 of FIG. 1, but incorporating a valve 200. Further, the means for exerting pressure takes the form of an air circuit 170, instead of the means 70 shown in FIG. 1. It should be understood that the hydraulic circuit assembly 150 of FIG. 3 could be incorporated in either the shoe assembly 40 or the feed assembly 80 or both. Similarly, the air circuit 170 could be incorporated into the assemblies 50 and 90 without the valve 200; and conversely, the valve 200 could be incorporated into assemblies 50 and 90 without the air circuit 170.

Accordingly, a centering assembly 140 is shown in FIG. 3. Assembly 140 comprises a set of biasing elements, each set made up of upper element 142*a* and lower element 142*b*. It should be understood that in a surfacing machine of the type disclosed, a series of element sets would be positioned across the width of the machine. The elements 142*a* and 142*b* are suitably mounted for movement by hydraulic assembly 150 operatively connected to each element set.

Assembly 150 comprises an upper double rod end hydraulic cylinder 152*a* and a lower double rod end hydraulic cylinder 152*b*. Each cylinder 152*a* and 152*b* contains a fluid (such as oil or any suitable liquid or gas) filled first chamber 154*a* and 154*b* and second chamber 156*a* and 156*b* respectively, separated by a piston 158*a* and 158*b* respectively. Pistons 158*a* and 158*b* move piston rods 160*a* and 160*b* respectively, which are operatively connected to elements 142*a* and 142*b*.

Cylinders 152*a* and 152*b* are operatively connected by a first conduit 166 and a second conduit 168. First conduit 166 provides fluid communication between first chamber 154*a* and second chamber 156*b*, while second conduit 168 provides fluid communication between second chamber 156*a* and first chamber 154*b*.

A valve 200 is operatively connected to first conduit 166 and second conduit 168, selectively providing fluid communication therebetween via conduit 202 and conduit 204. Valve 200 is preferably a mechanical "tee" valve, however any suitable valve is contemplated. When the valve 200 is closed, fluid communication between conduits 166 and 168 via conduits 202 and 204 is prevented, and the hydraulic assembly 150 functions as described with respect to assemblies 50 and 90. However, when the valve 200 is open, fluid communication between conduits 166 and 168 via conduits 202 and 204 is established, allowing each element 142*a* and 142*b* to move independently as described below.

Thus, when valve 200 is closed, as one of the pistons 158*a* or 158*b* moves, the other piston moves the same amount in the same direction relative to the center line (i.e, both move either away from the centerline or towards the centerline), since the volume of the fluid in the first chambers 154*a* and 154*b* and the volume in the second chambers 156*a* and 156*b* remain equal. Thus, if element 142*a* is forced away from centerline 117 by workpiece 115, piston 158*a* moves, forcing fluid out of first chamber 154*a*, through conduit 166, and into second chamber 156*b*. This in turn moves piston 152*b*, forcing fluid out of first chamber 154*b*, through conduit 168 and into second chamber 156*a*, thus moving element 142*b* away from the center line the same distance as element 142*a*.

When the valve 200 is open, conduits 166 and 168 are joined via conduits 202 and 204. Thus, as one of the pistons 158*a* or 158*b* moves, fluid will flow from one conduit 166 or 168 to the other via conduits 202 and 204 until equilibrium is achieved, without effecting the other pistons position. For example, if valve 200 is open and element 142*a* is forced away from centerline 117, piston 158*a* moves to force fluid out of chamber 154*a*. The fluid then follows the path of least resistance through conduit 166 to conduit 202, from conduit 202 to 204, and from conduit 204 to conduit 168, and finally into chamber 156*a*.

In this manner, piston 158*a* and element 142*a* have moved position, while piston 158*b* and element 142*b* have not moved. At this point, if the valve 200 is then closed, the elements 142*a* and 142*b* will again move together, and a new centerline position will have been established at a location equidistant from the elements 142*a* and 142*b*. This feature allows for easy adjustment of the center line location, and allows the oil volumes in each circuit to be reset to equal should a leak cause an unbalance in the system. The centerline can be reset to its initial or default location by opening the valve 200, moving the elements 142*a* and 142*b* to their outmost or home positions defined by element travel stops 210*a* and 210*b* respectively, and then closing the valve 200. Thus, the centerline will be set or rest at a location half the distant (d) between travel stops 210*a* and 210*b*.

Providing a centering force is a means 170 for exerting pressure in the form of an air circuit. Air circuit 170 provides air pressure through conduit 175 into an outer chamber 177*a* and 177*b* of cylinders 152*a* and 152*b* respectively. The air pressure acts upon piston 179*a* and 179*b* respectively to move rods 160*a* and 160*b* respectively. Air circuit 170 selectively provides adjustable pressure to the elements to help produce the desired centering effect. Inward travel of the elements 142*a* and 142*b* are limited by rod stops 212*a* and 212*b* respectively, contacting travel stops 210*a* and 210*b* respectively.

It should be understood that synchronized movement of the elements 142*a* and 142*b* could be achieved by providing pressure to a single chamber 177*a* or 177*b* when valve 200 is closed. When valve 200 is open, elements 142*a* and 142*b* can be moved independently by supplying any desired air pressure to the respective chamber 177*a* and 177*b*. Thus, it is contemplated that each chamber 177*a* and 177*b* could have its own air supply source.

It should be understood that the embodiments herein described are merely illustrative of the principles of the present invention. Various modifications may be made by those skilled in the art without departing from the spirit or scope of the claims which follow. For example, the hydraulic balancing circuit assembly could be used in any type of surfacing machinery, and in any type of shoe assembly or feed assembly. Further, the centering assembly of the present invention could be used in any machine or in any application where it is necessary of desired to center objects.

What is claimed is:

1. An apparatus for centering a workpiece along a centerline, said apparatus comprising:

at least one set of biasing means in said machine, said at least one set including a first biasing element and a second biasing element;

means for operatively connecting said first and second biasing elements for direct, selective movement relative to said centerline; and a means for applying pressure to said at least one set of biasing means.

2. The apparatus of claim 1, wherein said at least one set of biasing means is a shoe assembly.

3. The apparatus of claim 1, wherein said at least one set of biasing means is a feed assembly.

4. The apparatus of claim 1, wherein said means for operatively connecting consists of a hydraulic cylinder assembly.

5. The apparatus of claim 4, wherein said hydraulic cylinder assembly is a closed circuit, double rod end hydraulic cylinder assembly which directly connects said at least one set of biasing means.

6. The apparatus of claim 5, wherein said hydraulic cylinder assembly includes a valve.

7. The apparatus of claim 6, wherein said cylinder assembly providing synchronized movement of said first and second biasing element relative to said centerline when said valve is closed, such that when one of said first and second biasing element moves towards the centerline, then the other biasing element moves towards the centerline the same distance, and when one of said first and second biasing element moves away from the centerline, then the other biasing element moves away from the centerline the same distance.

8. The apparatus of claim 6, wherein said cylinder assembly providing independent movement of said first and second biasing element relative to said centerline when said valve is opened, such that when one of said first and second biasing element moves towards the centerline, the other biasing element is unaffected, and when one of said first and second biasing element moves away from the centerline, the other biasing element is unaffected.

9. The apparatus of claim 1, wherein said means for applying pressure is an air circuit operatively connected to said means for operatively connecting.

10. A centering assembly for centering workpieces, comprising:

at least one biasing element set comprising an upper element and a lower element defining a distance therebetween;

a means for directly synchronizing movement of said upper and lower elements; and a means for applying pressure to said at least one element set.

11. The assembly of claim 10, wherein said assembly further comprises a means for disengaging said means for synchronizing movement.

12. The assembly of claim 11, wherein said means for disengaging is a valve.

13. The assembly of claim 10, wherein said means for synchronizing movement comprises a closed circuit, double rod end hydraulic cylinder assembly directly connecting said upper element to said lower element.

14. The assembly of claim 13, wherein said closed circuit, double rod end hydraulic cylinder assembly comprises an upper hydraulic cylinder operatively and directly connected to said upper element, and a lower hydraulic cylinder operatively and directly connected to said lower element, said upper and lower hydraulic cylinders each having a first chamber and a second chamber, said first chamber of said upper hydraulic cylinder being in fluid communication with said second chamber of said lower hydraulic cylinder, and said second chamber of said upper hydraulic cylinder being in fluid communication with said first chamber of said lower hydraulic cylinder.

15. A method for centering workpieces comprising the steps of:

providing at least one set of upper and lower centering elements; and operatively and directly connecting said upper and lower elements for synchronized movement via a closed circuit, double rod end hydraulic cylinder assembly.

16. The method of claim 15 further comprising the step of providing a valve in said hydraulic cylinder assembly for enabling and disabling the synchronized movement.

17. A centering assembly comprising:

a first biasing element;

a second biasing element;

a closed circuit, double rod end hydraulic cylinder assembly having an upper hydraulic cylinder operatively and directly connected to said first element, and a lower hydraulic cylinder operatively and directly connected to said second element, said upper and lower hydraulic cylinders each having a first chamber and a second chamber, said first chamber of said upper hydraulic cylinder being in fluid communication with said second chamber of said lower hydraulic cylinder, and said second chamber of said upper hydraulic cylinder being in fluid communication with said first chamber of said lower hydraulic cylinder.

18. The centering assembly of claim 17, further comprising a valve for selectively operatively connecting in fluid communication said first and second chambers of said upper hydraulic cylinder, and said first and second chambers of said lower hydraulic cylinder.

19. The centering assembly of claim 17, further comprising an air circuit for selectively providing pressure to at least one of said upper and lower hydraulic cylinders.

* * * * *